United States Patent [19]

Suzuki et al.

[11] 4,435,492

[45] Mar. 6, 1984

[54] COMPLEX TYPE ELECTROPHOTOGRAPHIC PLATE AND ELECTROPHOTOGRAPHIC METHOD USING THE SAME

[75] Inventors: Shigeo Suzuki, Hitachi; Atsushi Kakuta, Hitachiota; Yasuki Mori; Hirosada Morishita, both of Hitachi, all of Japan

[73] Assignee: Hitachi, Ltd., Tokyo, Japan

[21] Appl. No.: 383,957

[22] Filed: Jun. 1, 1982

Related U.S. Application Data

[63] Continuation-in-part of Ser. No. 87,820, Oct. 24, 1979, abandoned.

[30] Foreign Application Priority Data

Oct. 27, 1978 [JP] Japan ..... 53-131523
Nov. 8, 1978 [JP] Japan ..... 53-136695

[51] Int. Cl.[3] ..... G03G 5/06; G03G 5/14

[52] U.S. Cl. ..... 430/58; 430/96; 430/77; 430/83

[58] Field of Search ..... 430/58, 59, 77, 83, 430/96

[56] References Cited

U.S. PATENT DOCUMENTS

| | | | |
|---|---|---|---|
| 3,622,316 | 11/1971 | Bird et al. | 430/83 X |
| 3,725,058 | 4/1973 | Hayashi et al. | 430/59 X |
| 3,837,851 | 9/1974 | Shattuck et al. | 430/59 |
| 3,887,366 | 6/1975 | Champ et al. | 430/77 X |
| 3,895,944 | 7/1975 | Wiedemann et al. | 430/59 |
| 3,955,978 | 5/1976 | Rochlitz | 430/59 |
| 3,958,991 | 5/1976 | Jones et al. | 430/83 X |
| 3,977,870 | 8/1976 | Rochlitz | 430/58 X |
| 3,982,935 | 9/1976 | Bartlett et al. | 430/77 X |
| 4,047,948 | 9/1977 | Horgan | 430/59 |
| 4,346,157 | 8/1982 | Kalcuta | 430/58 |

*Primary Examiner*—John E. Kittle
*Assistant Examiner*—John L. Goodrow
*Attorney, Agent, or Firm*—Antonelli, Terry & Wands

[57] ABSTRACT

In a complex type electrophotographic plate comprising an electroconductive support, superposed thereon a charge generating material (CGL) layer and a charge transport material layer superposed on the CGL layer when there is used as said charge transport material at least one compound of the formula:

$$X-(CH=CH)_n-CH=Y$$

wherein X is a heterocyclic group of the formula:

Y is a heterocyclic group of the formula:

these heterocyclic groups may be substituted by one or more lower alkyl groups, halogen atoms, or phenyl groups; Z is an oxygen, sulfur or selenium atom; R is an alkyl group having 1 to 7 carbon atoms; n is an integer of 1 or 2; and one hydrogen atom in the group of the formula —(CH=CH)$_n$— may be substituted by an alkyl group having 1 to 4 carbon atoms, a halogen atom, a phenyl group, a styryl group or a group of the formula:

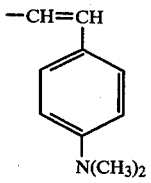

electrophotographic characteristics such as light sensitivity, dark decay characteristics, repetition characteristics, etc. are improved remarkably. An electrophotographic method using such an electrophotographic plate is also provided.

20 Claims, 2 Drawing Figures

COMPLEX TYPE ELECTROPHOTOGRAPHIC PLATE AND ELECTROPHOTOGRAPHIC METHOD USING THE SAME

CROSS-REFERENCE TO RELATED APPLICATION

This application is a continuation-in-part of application Ser. No. 87,820 filed Oct. 24, 1979 and now abandoned.

BACKGROUND OF THE INVENTION

This invention relates to a complex type electrophotographic plate containing at least one special organic pigment as charge transport material and an electrophotographic method using the same.

There have been known complex type electrophotographic plates disposing a photoconductive layer containing a charge generating material and a charge transport material on an electroconductive support. As typical charge generating materials, there has been known selenium (Se) and as typical charge transport materials, there have been known pyrazoline derivatives (U.S. Pat. No. 3,837,851) and oxadiazole derivative (U.S. Pat. No. 3,895,944) because of their excellent performance. As to the performance of selenium as charge generating material, there is no special problem but as to charge transport materials, these compounds mentioned above have many drawbacks. For example, although the pyrazoline derivatives have excellent light sensitivity, they have may drawbacks in that dark decay characteristics are poor, performance is lowered by repetitions of the use, and chemical stability of the compounds themselves is poor. On the other hand, the oxadiazole derivatives have a drawback in that light sensitivity is low.

SUMMARY OF THE INVENTION

It is an object of this invention to provide a complex type electrophotographic plate excellent in light sensitivity and dark decay characteristics. It is another object of this invention to provide a complex type electrophotographic plate which shows little lowering in performance even if repeating processes of charging, exposure to light and development (hereinafter referred to as "repetition characteristics"). It is a further object of this invention to provide a complex type electrophotographic plate containing a charge transport material which is chemically stable. It is a still further object of this invention to provide an electrophotographic method showing excellent recording performance.

This invention provides a complex type electrophotographic plate comprising an electroconductive support; a first layer, adhered to the support, of a charge generating material, sid first layer having a thickness of 0.1 to 5 μm; and a second layer, superposed on the first layer, of a homogeneous mixture of a charge transport material and an insulating resinous binder therefor, said second layer having a thickness of 5 to 100 μm and being substantially transparent to light of a wavelength of 4200 to 8000 Å, and said charge transport material being at least one member selected from the group consisting of nonionic compounds represented by the general formula:

$$X—(CH=CH)_n—CH=Y \quad (I)$$

wherein X is a heterocyclic group of the formula:

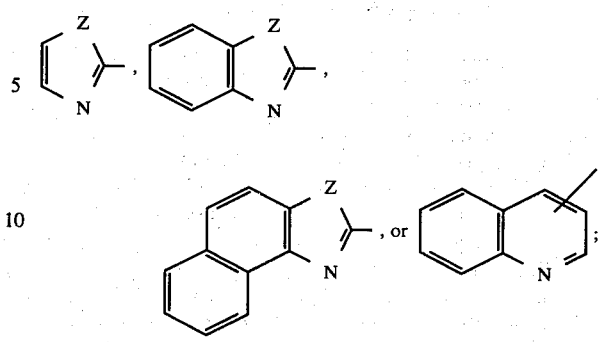

Y is a heterocyclic group of the formula:

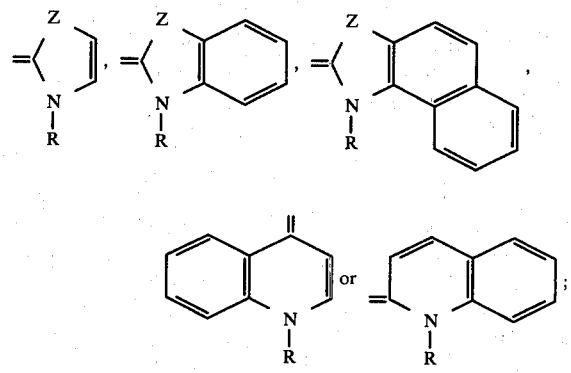

these heterocyclic groups may be substituted by one or more lower alkyl groups, halogen atoms, or phenyl groups; Z is an oxygen, sulfur or selenium atom; R is an alkyl group having 1 to 7 carbon atoms; n is an integer of 1 or 2; and one hydrogen atom in the group of the formula $—(CH=CH)_n—$ may be substituted by an alkyl group having 1 to 4 carbon atoms, a halogen atom, a phenyl group, a styryl group, a group of the formula $—N(CH_3)_2$, $—N(C_2H_5)_2$ or $—N(C_3H_7)_2$, an alkoxy group having 1 to 4 carbon atoms, or a group of the formula:

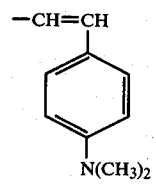

This invention also provides an electrophotographic method comprising a first step of charging an electrophotographic plate, a second step of exposing it to light and a third step of developing it, said method being characterized by using the electrophotographic plate mentioned above and charging it negatively.

DESCRIPTION OF PREFERRED EMBODIMENTS

Figure 1:
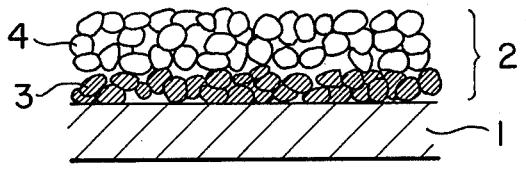
FIG. 1 is a cross-sectional view of the electrophotographic plate of this invention.

The charge transport material must meet the following requirements; an effective injection of light carrier (charged particle) generated in the charge generating material by light irradiation is possible; an appropriate light absorption range for not disturbing the specific range of wavelength (4200–8000 Å) to be absorbed by the charge generating material is possessed; distinguished charge transport characteristics are possessed, etc. But it is very difficult to prepare a material satisfying all these requirements. As is well known, the charge generating material photosynthesizes pairs of electrons and holes by light irradiation, and either electrons or holes are injected into the charge transport material as light carriers, and transported. In that case, however, there is a distinct correlation between the effective injection of light carriers and the ionization potential or the electron affinity of the charge transport material. It has been disclosed as a result of studies that, when electrons are used as the injected carrier, the electron affinity should be high, whereas when the holes are used as the injected carrier, the ionization potential should be low. On the other hand, as to an improvement of the important characteristics of electrophotographic plate, that is, durability and repetition characteristics, any definite guideline has not been established yet. Further, the charge transport layer material should have such properties as reaching the light effectively to the charge generating layer and effectively transporting the charge generated in the charge generating layer. Therefore, it is important to find out most suitable materials for the charge transport layer, taking the relationships between degree of coloring, the thickness of the charge transport layer and properties such as sensitivity, etc., into consideration.

As a result of various studies on the foregoing prior art knoledge and materials having very slight coloring, the present inventors have found that the compounds represented by the formula (I) have distinguished characteristics as the charge transport material and have accomplished this invention.

In the compound of the formula (I), one or two hydrogen atoms in the heterocyclic group may be substituted by one or two lower alkyl groups, halogen atoms, or phenyl groups and one hydrogen atom in the group of the formula $-(CH{=}CH)_n-$ may be substituted by a lower alkyl group such as $-CH_3$, $-C_2H_5$, $-C_3H_7$, and the like, a halogen atom such as —Cl, —Br, and the like, a styryl group, a phenyl group, a lower alkoxy group such as $-OCH_3$, and the like, a group of the formula, $-N(CH_3)_2$, $-N(C_2H_5)_2$, $-N(C_3H_7)_2$, or

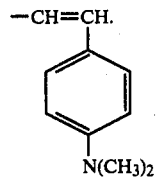

Examples of the compounds of the formula (I) are as follows.

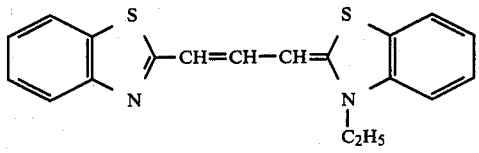

(1)

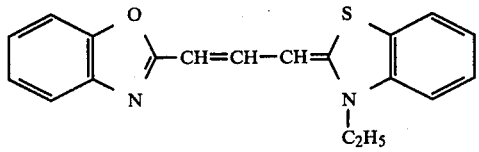

(2)

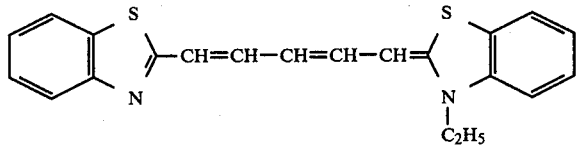

(3)

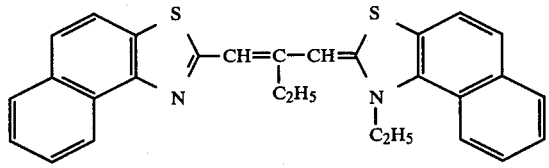

(4)

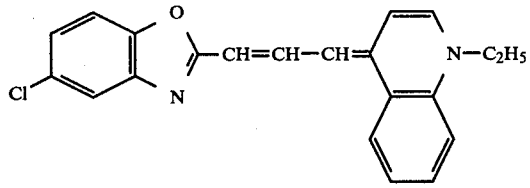

(5)

-continued
(6)
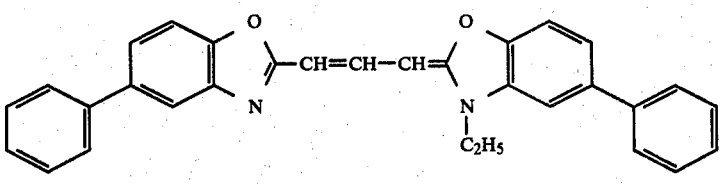
(7)
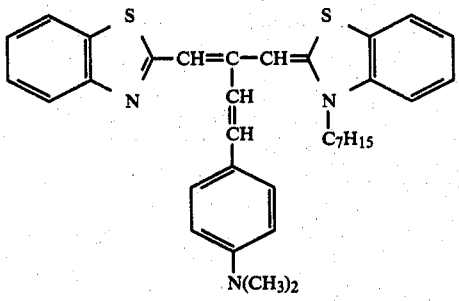
(8)
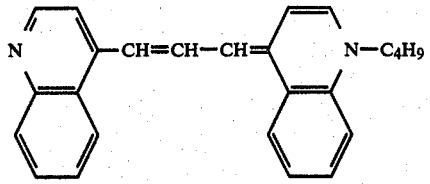
(9)
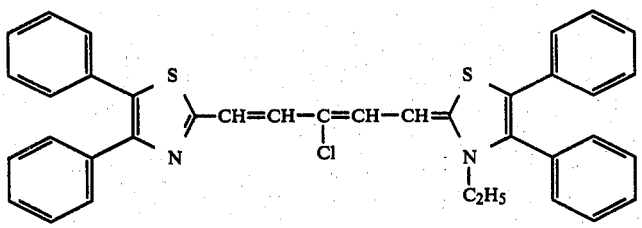
(10)
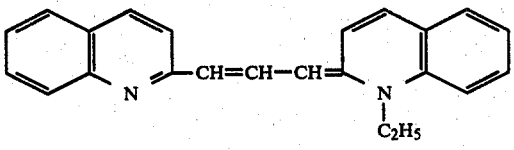
(11)
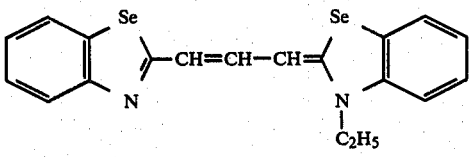
(12)
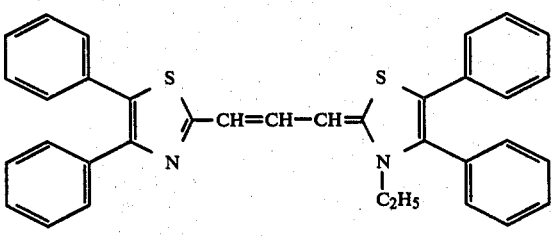
(13)
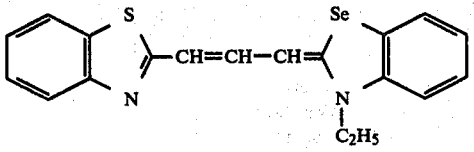

-continued

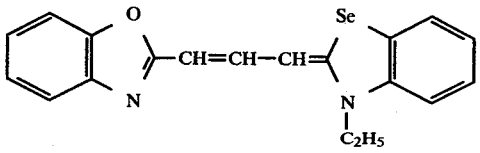

(14)

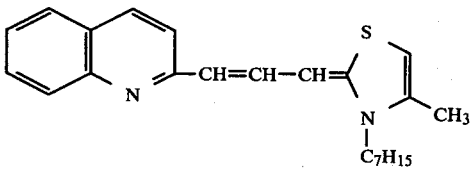

(15)

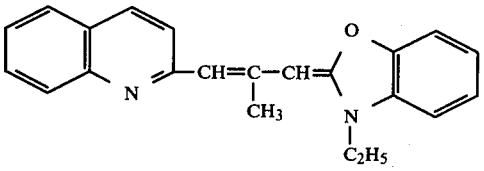

(16)

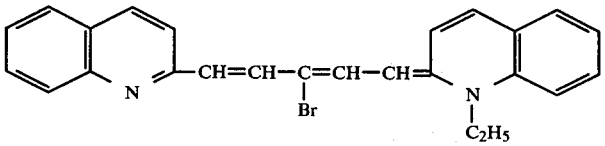

(17)

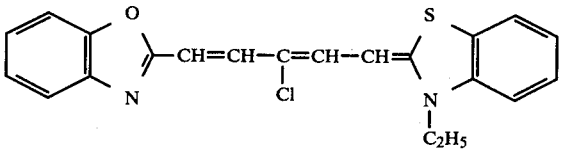

(18)

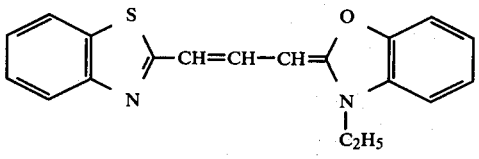

(19)

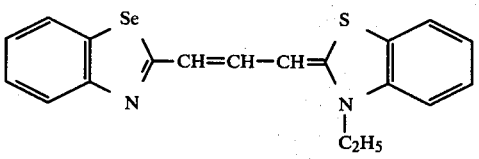

(20)

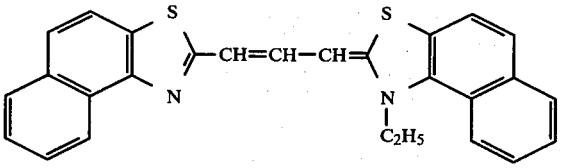

(21)

A general method for synthesizing these compounds mentioned above is disclosed in, e.g., G.S. Brooker et al., Journal of American Chemical Society vol. 62, pages 1116–1125 (1940).

The charge transport materials mentioned above are particularly effective in a complex type electrophotographic plate using holes as light carrier as mentioned in detail in the Examples mentioned below. A double layer type electrophotographic plate having a layer of charge generating material as a lower layer as shown in FIG. 1 shows high sensitivity when charged negatively. In order to conduct injection of the holes generated by light irradiation effectively into the layer of charge transport material, the charge transport material should have low ionization potential. In fact, the compounds of the formula (I) have ionization potential values of 6.6 eV or less individually and belong to the group having very low ionization potential values among organic compounds. Particularly when the electrophotographic plate of this invention is applied to sensitized plates for copying devices or sensitized plates for laser printers having a visible-light laser as light source, it is desirable to use a charge transport material which has good transparency and is easy to blend with polymer compounds.

Taking the low ionization potential and transparency into consideration, the compounds of the formula:

$$X'-(CH=CH)_n-CH=Y' \quad (II)$$

wherein X' is a heterocyclic group of the formula:

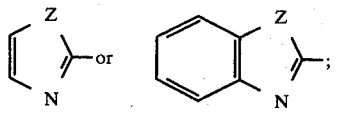

Y' is a heterocyclic group of the formula

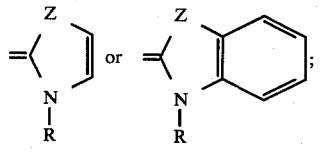

Z is oxygen or sulfur; R is an alkyl group having 1 to 2 carbon atoms; n is an integer of 1 or 2, more preferably n is 1; the heterocyclic group may be substituted by a phenyl group or halogen atoms, are preferable among the compound of the formula (I).

On the other hand, in the case of printer having as a light source near infrared light such as semiconductor lasers, or light emitting diodes, etc., the above-mentioned requirements are not necessary and the compounds of the formula (I) but outside the scope of the compounds of the formula (II) and having the lowest ionization potential are preferable. Some of these compounds are poor in dissolubility with polymeric compounds but a thin layer of these compounds can directly be formed by physical and chemical processes such as vacuum evaporation, electrode reactions, and the like.

Figure 2:
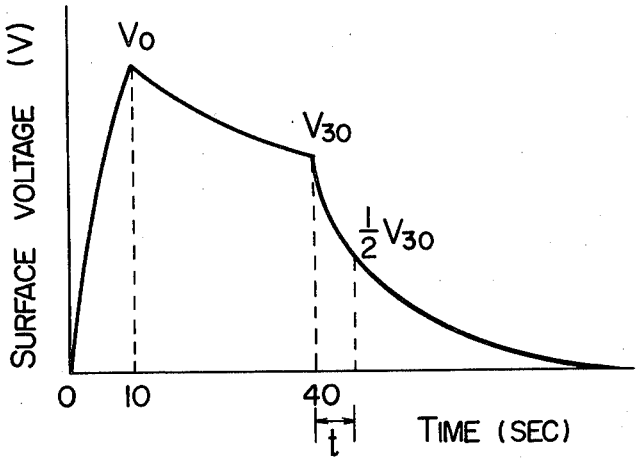
FIG. 2 is a graph showing an example of measuring charging characteristics of the electrophotographic plate when subjected to dark decay and exposure to light.

Characteristics of sensitized plates for copying devices and printers can be evaluated by an initial voltage, dark decay, half decay exposure sensitivity, and the like. A general method for measuring these values widely used in the art is as follows. Using an electrostatic recording paper analyzer (e.g. SP-428 made by Kawaguchi Electric Works Co., Ltd., Japan) and as shown in FIG. 2, an electrophotographic plate is corona charged at minus or plus 5 kV for 10 seconds for charging (surface voltage immediately after the charging for 10 seconds is expressed by $V_o$ volt and is defined as initial voltage), and then it is allowed to stand in the dark for 30 seconds (surface voltage at this time is expressed by $V_{30}$ volt and the ratio $V_{30}/V_0 \times 100$ is defined as dark decay), and it is exposed to light from a tungsten lamp of 20 luxes. The sensitivity $E_{50}$ is defined as the power of light times the time t to decay a half of the surface potential $V_{30}$; $E_{50}=20\times t$ (lux-second).

The characteristics required for the electrophotographic plate for practical use are varied depending on utility but in general are 200 V or more, preferably 500 V or more of initial voltage $V_0$, 50% or more, preferably 70% or more of dark decay $V_{30}/V_0$ and 20 lux-second or less, preferably 10 lux-second or less of half decay exposure sensitivity $E_{50}$. Further it is desirable that these characteristics are satisfied after $10^3$ repeated continuous uses.

A particle size of the charge transport material can be selected from a considerably wide range. In general, a particle size of 5 μm or less is used. A particle size of 1 μm or less is more preferable. The smaller the particle size becomes, the more effective it becomes. On the other hand, if the particle size is extremely large, injection of carriers from the charge generating material to the charge transport material becomes insufficient and there takes place a remarkable decrease in sensitivity.

The charge generating material and the charge transport material can form separate layers as shown in FIG. 1 to constitute a so-called photoconductive double layer. In FIG. 1, the numeral 1 denotes an electroconductive layer and the numeral 2 denotes a photoconductive layer which is constituted from a charge generating material layer 3 disposed on the electroconductive layer 1 and a charge transport material layer 4.

Thickness of the charge generating material layer 3 is generally 0.1 to 5 μm and that of the charge transport material layer 4 is generally 5 to 100 μm. In any case, the thickness of these layers is desirably decided finally so as not to damage light sensitivity, that is, charging characteristics. But if the photoconductive layer becomes too thick, there is a fear of lowering flexibility of the layer itself and this must be noted.

As the charge generating material, conventional ones are usable. Examples of the charge generating materials are organic pigments including azo pigments such as monoazo, disazo, trisazo, etc.; azo lake pigments; phthalocyanine pigments such as copper, magnesium, lead, or zinc phthalocyanine, halogenated copper phthalocyanine, etc.; thioindigo series, anthraquinone series, perynone series, and perylene series pigments; dioxazine series, quinacridone series, isoindolinone series, fluorbine series and pyrrocoline series pigments; triphenylmethane series pigments; metal complex type pigments; inorganic pigments such as selenium (Se), tellurium (Te), cadmium sulfoselenide (CdSSe), arsenic selenide ($As_2Se_3$), antimony sulfide ($Sb_2S_3$), antimony selenide ($Sb_2Se_3$), cadmium sulfide (CdS), cadmium selenide (CdSe), cadmium telluride (CdTe), zinc oxide (ZnO), zinc sulfide (ZnS), or mixtures thereof or alloys thereof; various dyes including acid azo dyes such as monoazo, disazo, etc,; acid mordant dyes such as o-hydroxycarboxylic acid type, peridihydroxy type, ortho-oxazo type, etc.; direct azo dyes such as benzidine type, diaminodiphenylamine type, stilbene type, J acid type, continuous azo type, thiazole type, urea type, cyanuric acid type, etc.; metal complex dyes such as chromium complex type, Neolan series, Palatine Fast series, Benzofast Chromium series, copper complex type, etc.; basic azo dyes; azoic dyes; anthraquinone series mordant dyes such as alizarin series, trioxyanthraquinone series, polyoxyanthraquinone series, etc.; anthraquinone series acid dyes; anthraquinone series vat dyes such as indanthrone series, flavanthrene series, pyranthrene series, amylaminoanthraquinone series, anthrimide series, anthraquinone carbazole series, acridine series, thioxanthene series, benzanthrone series, dibenzpyrenequinone series, anthanthrone series, pyrazolanthrone series, pyrimidoanthrone series, thiazole series, thiophene series, imidazole series, phthalic carboxylic acid series, various quinone series, etc.; indigoid dyes such as indocolindigo series, thioindigo series, etc.; solubilized vat dyes such as anthrasol series, Soledon series, etc.; sulfur dyes; carbonium dyes such as diphenylmethane series, triphenylmethane series, xanthene series, phthalein series, acridine series, etc.; quinonimine dyes such as azine series, oxazine series, thiazine series, etc.; phthalocyanine dyes, cyanine dyes; quinoline dyes; nitro dyes; nitroso dyes; naphthoquinone dyes; Procion dyes; fluorescent dyes; and the like. These pigments and dyes can be used alone or as a mixture of two or more of them. Among them, the use of at least one member selected from the group consisting of disazo pigments, squaric acid methine pigments and phthalocyanine pigments as the charge generating layer material is particularly preferable in the combination with the special charge transport layer material mentioned above.

A particle size of the charge generating material can be selected from a considerably wide range. In general, those having a smaller particle size are advantageous. The particle size is preferably 5 μm or less, more preferably 1 μm or less.

It is possible to use conventional binders and sensitizers in the electrophotographic plate of this invention. Examples of the binders are synthetic resin binders, e.g. linear saturated polyester resins such as polyethylene terephthalate, and the like, polycarbonate resins, acrylic resins, polyvinyl butyral, polyketone resins, polyurethane resins, poly-N-vinyl carbazole, poly(p-vinylphenyl)anthracene, terpene resins, rosin and the like. These binders can be used alone or as a mixture of two or more of them. The binder should be added to at least the charge transport material layer 4 and in such a case it is proper to use 1 to 50 parts by weight of the binder per part by weight of the charge transport material.

As the sensitizers, there can be used conventional ones such as organic pigments, dyes, charge transfer complexes, Lewis acids, amino compounds and the like. It is preferable to add the sensitizer at least to the charge generating material layer 3, and in such a case, it is proper to use 1 to 80% by weight of the sensitizer based on the total weight of the charge generating material layer (including the sensitizer).

As the electroconductive layer, there can be used conventional ones such as aluminum, brass, copper, gold, palladium, tin oxide, indium oxide, etc., or their alloys. The electroconductive layer by itself may have a function of supporting the photoconductive layer. For example, an electrophotographic plate can be produced by using as the electroconductive layer a plate or cylinder made of such a metal as mentioned above or a plate or cylinder coated with such a metal as mentioned above and forming a photoconductive layer on the surface thereof. Alternatively, the electroconductive layer may be formed on a supporting substrate such as a plastic film or paper. Such a type of substrate is particularly suitable for giving long size electrophotographic plates. Further the electroconductive layer can be formed by disposing a thin layer of aluminum iodide, copper iodide, chromium oxide, or tin oxide, on a glass substrate such as a glass plate or cylinder.

This invention is illustrated by way of the following Examples, in which all percents and parts are by weight unless otherwise specified.

EXAMPLE 1

A 1% solution of a disazo pigment, chlorinated Diane Blue having the formula:

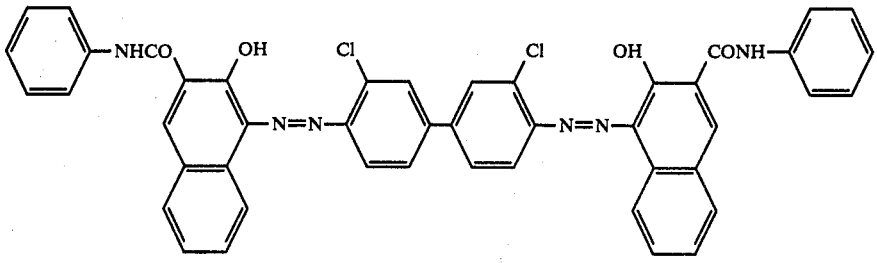

dissolved in a mixed solvent of ethylenediamine and n-butylamine (1:1 by volume) was coated on an aluminum plate of 100 μm thick with an applicator and dried to form a charge generating material layer of about 1 μm thick.

Subsequently, the compound of the formula:

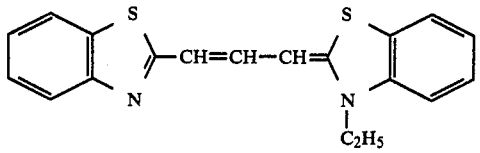

(1)

(NK-2321 manufd. by Japanese Research Institute for Photosensitizing Dyes, Ltd., Japan) was mixed with polycarbonate resin (Iupilon S-2000 manufd. by Mitsubishi Gas-Chemical Co., Inc. Japan) in 1:2 by weight and dissolved in dichloromethane to prepare a 16% solution. The solution was coated on the charge generating material thin layer with an applicator and dried to form a charge transport material layer of about 30 μm thick. Particle sizes of the charge transport material are 5 μm or less at most when the cross-section of the charge transport material layer was observed by a microscope.

Electrophotographic characteristics of the thus produced complex type electrophotographic plate were evaluated by using an electrostatic recording paper analyzer (SP-428 made by Kawaguchi Electric Works Co., Ltd., Japan). It was found that a half decay exposure sensitivity of the electrophotographic plate to white light was less than 4 lux-second, which was satisfactory in practical use. Further, repetition characteristics were evaluated by using the same analyzer with a result in that there was no tendency to lower the electrophotographic characteristics including the half decay exposure sensitivity even after more than $10^3$ repetitions.

EXAMPLE 2

A complex type electrophotographic plate was produced in the same manner as described in Example 1 except for using as the charge transport material the compound of the formula:

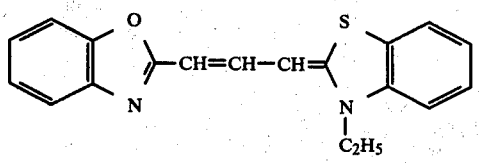

(2)

and as the binder a polyketone resin. The resulting charge transport material layer had a thickness of about 100 μm. The resulting electrophotographic plate was subjected to the same test as in Example 1, and a half decay exposure sensitivity of less than 10 lux-second and durability to more than $10^3$ repetitions were shown.

EXAMPLE 3

A 1% solution was prepared by mixing a squaric acid methine dye having the formula:

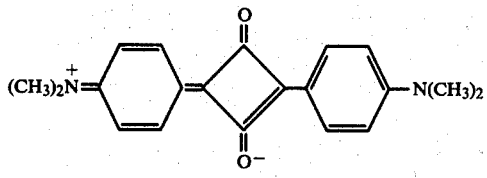

with a polyvinyl butyral (XYHL manufd. by Union Carbide Corp., U.S.A.) in 1:2 by weight and using tetrahydrofuran as a solvent and ball milling the resulting mixture. The resulting coating solution was coated on an aluminium plate using an applicator and dried to form a charge generating material layer of about 0.1 μm thick.

Then, a charge transport material selected from 4 kinds of the compound numbers (3) to (6) as listed in Table 1 was mixed with an acrylic resin (Elvacite 2045 manufd. by E. I. du Pont de Nemours Co., U.S.A.) in 1:5 by weight and a mixed solvent of dichloromethane and benzene (1:1 by volume) was added thereto to give a 10% coating solution after ball milling. The coating solution was coated on the charge generating material thin film previously formed and dried to give a charge transport material layer of about 20 μm thick.

The thus produced complex type electrophotographic plates were subjected to the same test as in Example 1 to measure a half decay exposure sensitivity and repetition characteristics. The results are as shown in Table 1.

TABLE 1

| Compound No. | Charge transport material: Structural formula | Half decay exposure sensitivity (lux-second) | Repetition characteristics (times) |
|---|---|---|---|
| 3 | 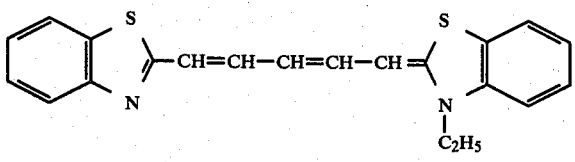 | <10 | $>10^3$ |
| 4 | 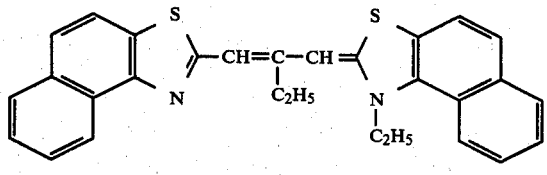 | <10 | $>10^3$ |
| 5 | 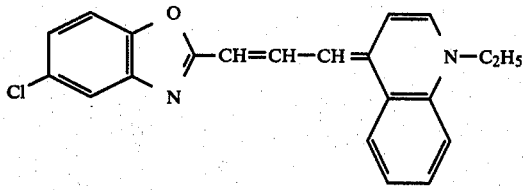 | 20 | $>10^3$ |
| 6 | 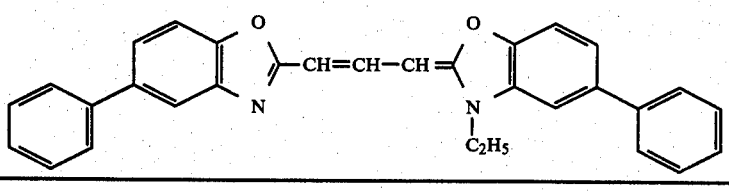 | 20 | $>10^3$ |

As is clear from Table 1, each electrophotographic plate showed a good half decay exposure sensitivity of 20 lux-second or less and possibility of durability to more than $10^3$ repetitions.

EXAMPLE 4

Complex type electrophotographic plates were produced in the same manner as described in EXAMPLE 1 except for using the compounds listed in Table 2 as the charge transport material and 50 parts of the polycarbonate resin per part of the charge transport material. The thickness of the charge generating material layer was about 5 μm and that of the charge transport material layer was about 100 μm. The electrophotographic plates were subjected to the same test as in Example 1. The results are as shown in Table 2.

As is clear from Table 2, each electrophotographic plate showed a good half decay exposure sensitivity of 30 lux-second or less and possibility of durability to more than $10^3$ repetitions.

TABLE 2

| Compound No. | Charge transport material: Structural formula | Half decay exposure sensitivity (lux-second) | Repetition characteristics (times) |
|---|---|---|---|
| 10 | 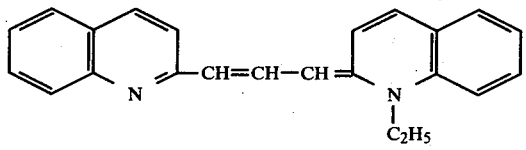 | 20 | $>10^3$ |
| 11 | 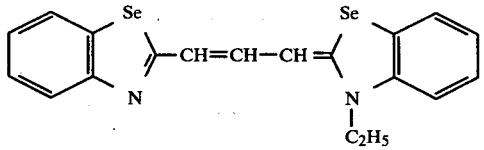 | <10 | $>10^3$ |
| 12 | 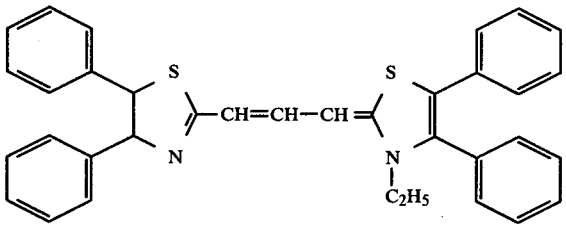 | 15 | $>10^3$ |
| 13 | 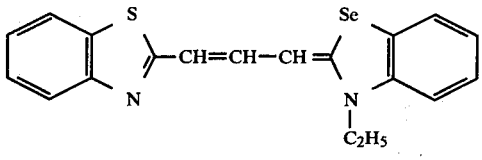 | <10 | $>10^3$ |
| 14 | 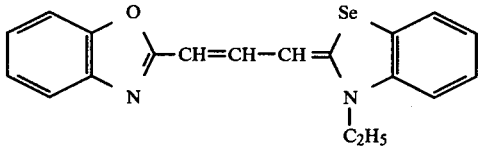 | 15 | $>10^3$ |
| 15 | 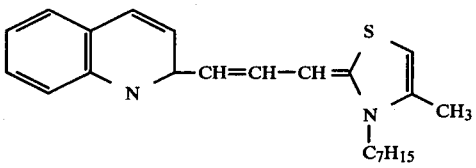 | 25 | $>10^3$ |
| 16 | 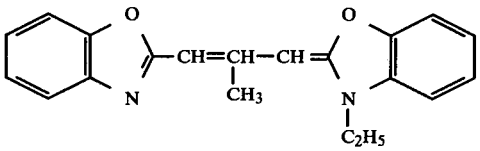 | 20 | $>10^3$ |
| 17 | 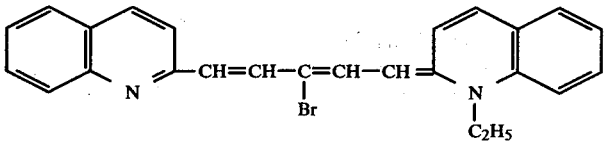 | 30 | $>10^3$ |

TABLE 2-continued

| Compound No. | Charge transport material Structural formula | Half decay exposure sensitivity (lux-second) | Repetition characteristics (times) |
|---|---|---|---|
| 18 | 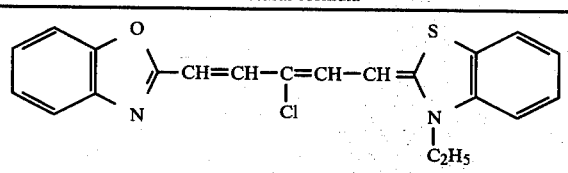 | 30 | $>10^3$ |
| 19 | 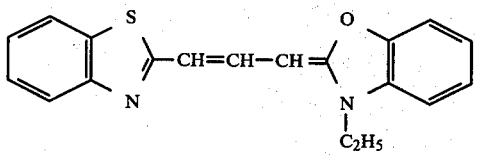 | 15 | $>10^3$ |
| 20 | 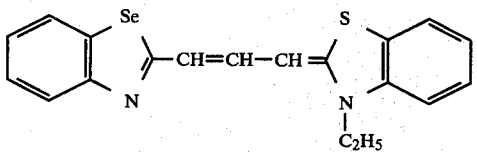 | <10 | $>10^3$ |
| 21 | 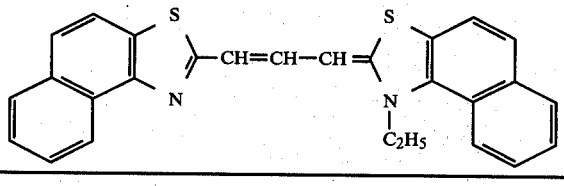 | <10 | $>10^3$ |

Comparative Example 1

Complex type electrophotographic plates were produced in the same manner as described in Example 1 except for using as the charge transport material a pyrazoline derivative of the formula:

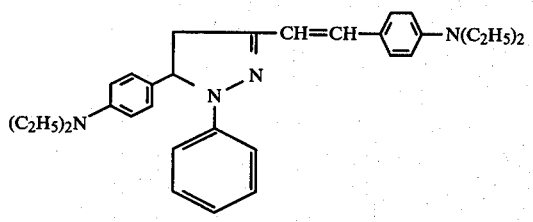

and changing the mixing ratio of the charge transport material to the binder (the polycarbonate resin) as shwon in Table 3. Various characteristics of the electrophotographic plates are as shown in Table 3.

TABLE 3

| Run No. | 1 | 2 |
|---|---|---|
| Charge transport material (part) | 1 | 1 |
| Binder (part) | 2 | 1 |
| Characteristics | | |
| Initial voltage (V) | 700 | 400 |
| Dark decay (%) | 60 | 44 |
| Half decay exposure sensitivity (lux-second) | 4 | 3 |
| Repetition characteristics (times) | $10^3$ | $10^2$ |

As is clear form Table 3, the pyrazoline derivative is excellent in light sensitivity but remarkably poor in dark decay (the value of dark decay being remarkably lowered, that is, dark current being increased). The above-mentioned tendency agrees to lowering in repetition characteristics. On the other hand, as to phosphorescence of the pyrazoline derivative, phosphorescence of the pyrazoline derivative disappeared after repeating ultraviolet-light irradiation (phosphorescence excitation) only several times and phosphorescence of a pyrazole derivative was retained. As mentioned above, the pyrazoline derivative is remarkably influenced by ultraviolet light and all te pyrazoline derivative in the state of a solution is changed to a pyrazole derivative in a day. Needless to say, the pyrazole derivative does not show light sensitivity at all and thus cannot be used for electrophotographic plates.

Comparative Example 2

A complex type electrohotographic plate was produced in the same manner as described in Example 1 except for using as the charge transport material the oxazole derivative of the formula:

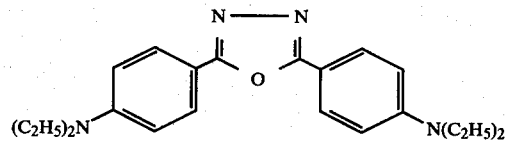

Half decay exposure sensitivity of the electrophotographic plate was 57 lux-second, which is lower in sensitivity than that of this invention.

EXAMPLE 5

A 6% solution was prepared by mixing 1 part of $\beta$-type non-metal phthalocyanine (Heliogen Blue 7800 manufd. by Badische Anilin- & Soda-Fabrik A.G., West Germany) and 0.5 part of a polyvinyl butyral (XYHL manufd. by Union Carbide Corp., U.S.A.) together with xylene as a solvent and ball milling the mixture for 5 hours. The solution was coated on a copper plate of 100 μm thick by using an applicator and dried to form a charge generating material layer of about 5 μm thick. The particle size of the charge generating material was 1 μm or less. A 16% coating solution was prepared by mixing 1 part of the compound of the formula:

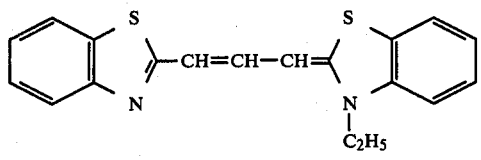
(1)

(NK-2321 manufd. by Japanese Research Institute for Photosensitizing Dyes, Ltd., Japan) as the charge transport material and 2 parts of a polycarbonate (Iupilon S-2000 manufd. by Mitsubishi Gas-Chemical Co., Inc., Japan) together with dischloromethane as a solvent. The coating solution was coated on the charge generating material layer by using an applicagor and dried to form a charge transport material layer of about 30 μm. The resulting complex type electrophotographic plate was subjected to the same test as in Example 1. Half decay exposure sensitivity of the electrophotographic plate was 10 lux-second, which was satisfactory in practical use. Further, there was no tendency to lower the electrophotographic characteristics including the half decay exposure sensitivity even after more than $10^3$ repetitions.

EXAMPLE 6

A charge generating material layer was formed in the same manner as described in Example 5. Subsequently, a suspension was prepared by mixing 1 part of a charge transport material selected from the compound Nos. (3), (4) and (6) mentioned below and 5 parts of an acrylic resin (Elvacite 2045 manufd. by E. I. du Pont de Numours Co., U.S.A.) together with a mixed solvent of dichloromethane and benzene (1:1 by volume). The suspension was coated on the charge generating material layer and dried to form a charge transport material layer of about 20 μm thick. Each electrophotographic plate was subjected to the same test as in Example 1. The results are as shown in Table 4.

TABLE 4

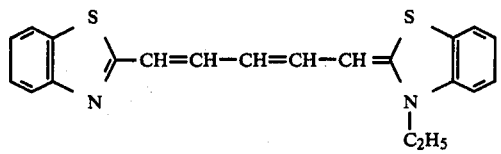
(3)

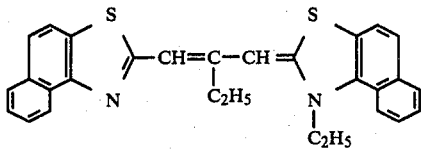
(4)

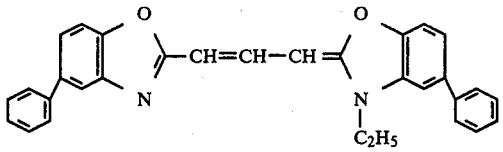
(6)

| Compound No. | Half decay exposure sensitivity (lux-second) | Repetition characteristics (times) |
|---|---|---|
| 3 | <10 | $>10^3$ |
| 4 | <10 | $>10^3$ |
| 6 | 20 | $>10^3$ |

EXAMPLE 7

A coating dispersion was prepared by adding 0.15 g of phthalocyanine pigment (Fastogen Blue FGF manufd. by Dainippon Ink and Chemicals, Inc., Japan) and 0.05 g of monoazo lake pigment (Resino Red BX manufd. by Konishi Ganryo Ltd., Japan) as the sensitizer to 2 ml of diethylamine and conducting ultrasonic dispersion. The resulting coating dispersion was coated on an aluminum plate by using a doctor blade. The pigment particles were crushed to particle sizes of 5 μm or less by ultrasonic dispersion. The thickness of the resulting layer was 5 μm.

A coating solution was prepared by mixing 0.3 g of poly-9-(p-vinylphenyl)-anthracene with 0.15 g of the charge transport material having the formula:

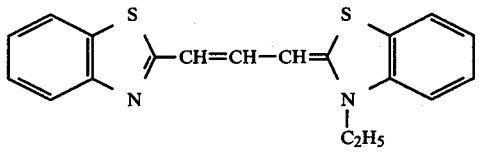
(1)

together with 4 ml of 1,2-dichloroethane as a solvent. The coating solution was coated on the charge generating material layer to form a charge transport material layer of about 5 μm thick. The resulting electrophotographic plate was subjected to the same test as in Example 1. Half decay exposure sensitivity was 10 lux-second and durability to more than $10^3$ repetitions was possible.

The electrophotographic plate of this invention can be used widely, for example, in copying devices, printers, display elements and as printing original plates. Further, according to the electrophotographic method of this invention using the special charge transport material, recording performance is excellent and said method can be applied to not only conventional copying devices but also laser beam printers in which high-speed recording is possible.

The special charge transport material used in this invention can be applied to any conventional electrophotographic methods. A typical example of such methods is as follows. Said method comprises a first step of charging an electrophotographic plate in the dark, a second step of exposing it to light to form electrostatic latent images, a third step of developing with developing agents, and a step of transferring toners to a recording medium such as paper, and if necessary, a step of setting the toners by applying heat and/or pressure. Another example of such methods comprises a step of charging an electrophotographic plate in the dark, a step of exposing it to light to form electrostatic latent images, a step of transferring the electrostatic latent images to a recording medium such as paper, and a step of developing the latent images by using developing agents, and if necessary, a step of setting toners by applying heat and/or pressure. Other conventional electrophotographic methods can be applied for using the special charge transport material used in this invention.

What is claimed is:

1. A complex type electrophotographic plate comprising an electroconductive support; a first layer, adhered to the support, of a charge generating material, said first layer having a thickness of 0.1 to 5 μm; and a second layer, superposed on the first layer, of a homogeneous mixture of a charge transport material and an insulating resinous binder therefor, said second layer having a thickness of 5 to 100 μm being substantially transparent to light of a wavelength of 4200 to 8000 Å, and said charge transport material being at least one member selected from the group consisting of nonionic compounds represented by the general formula:

$$X-(CH=CH)_n-CH=Y$$

wherein X is a heterocyclic group of the formula:

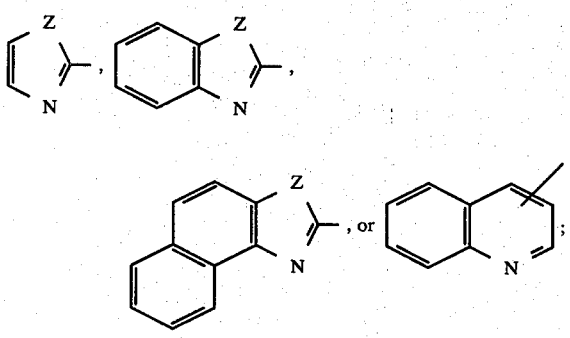

Y is a heterocyclic group of the formula:

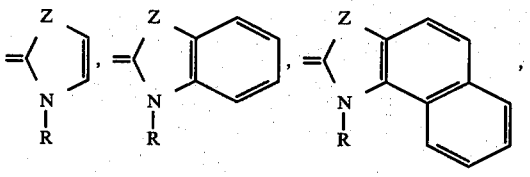

-continued

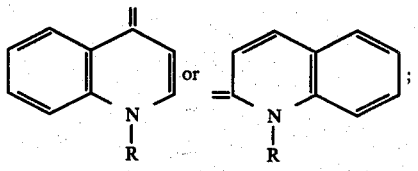

these heterocyclic groups may be substituted by one or more lower alkyl groups, halogen atoms, or phenyl groups; Z is an oxygen, sulfur or selenium atom; R is an alkyl group having 1 to 7 carbon atoms; n is an integer of 1 or 2; and one hydrogen atom in the group of the formula $-(CH=CH)_n-$ may be substituted by an alkyl group having 1 to 4 carbon atoms, a halogen atom, a phenyl group, a styryl group, a group of the formula $-N(CH_3)_2$, $-N(C_2H_5)_2$ or $-N(C_3H_7)_2$, an alkoxy group having 1 to 4 carbon atoms, or a group of the formula:

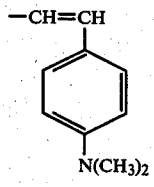

2. A complex type electrophotographic plate comprising an electroconductive support; a first layer, adhered to the support, of a charge generating material, said first layer having a thickness of 0.1 to 5 μm, and said charge generating material being at least one member selected from the group consisting of disazo pigments, squaric acid methine pigments, and phthalocyanine pigments; and a second layer, superposed on the first layer, of a homogeneous mixture of a charge transport material and an insulating resinous binder therefor, said second layer having a thickness of 5 to 100 μm and being substantially transparent to light of wavelength of 4200 to 8000 Å, and said charge transport material being at least one member selected from the group consisting of nonionic compounds represented by the general formula:

$$X-(CH=CH)_n-CH=Y$$

wherein X is a heterocyclic group of the formula:

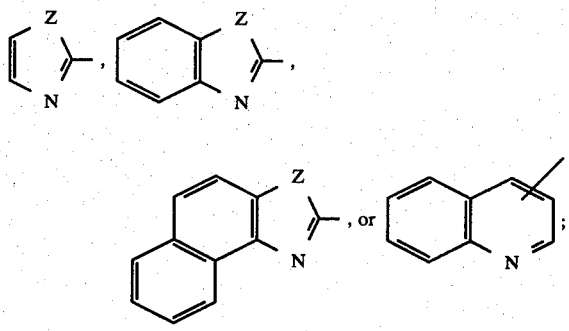

Y is a heterocyclic group of the formula:

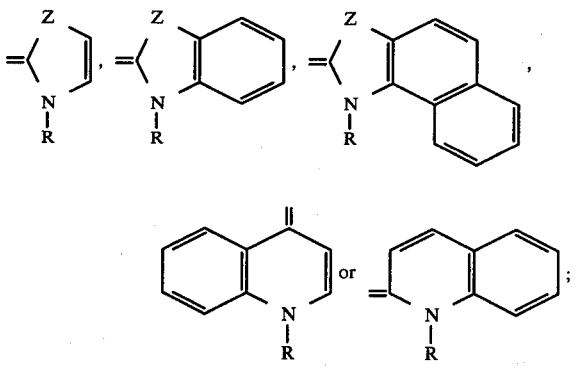

these heterocyclic groups may be substituted by one or more lower alkyl groups, halogen atoms, or phenyl groups; Z in an oxygen, sulfur or selenium atom; R is an alkyl group having 1 to 7 carbon atoms; n is an integer of 1 or 2; and one hydrogen atom in the group of the formula $-(CH=CH)_n-$ *may be substituted by an alkyl group having* 1 to 4 carbon atoms, a halogen atom, a phenyl group, a styryl group, a group of the formula $-N(CH_3)_2$, $-N(C_2H_5)_2$ or $-N(C_3H_7)_2$, an alkoxy group having 1 to 4 carbon atoms, or a group of formula:

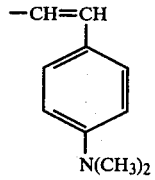

3. A complex type electrophotographic plate according to claim 1 or 2, wherein the charge transport material is at least one compound selected from the group consisting of the following compounds of (1) to (21):

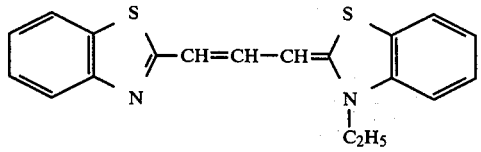

(1)

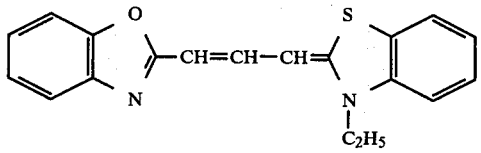

(2)

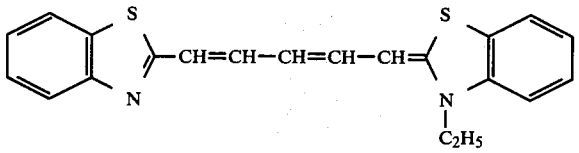

(3)

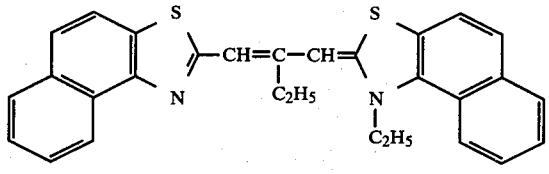

(4)

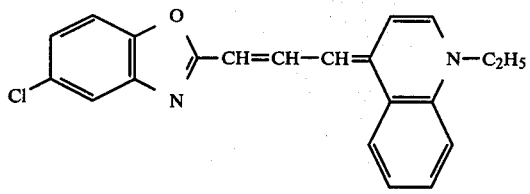

(5)

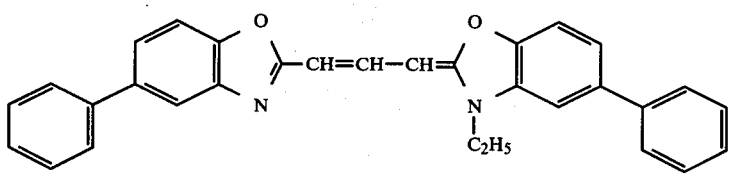

(6)

-continued
(7)
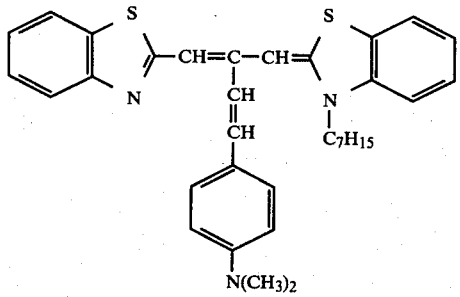
(8)
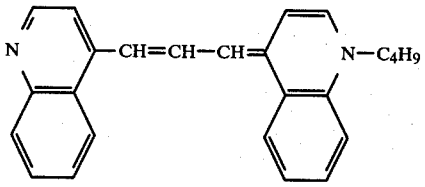
(9)
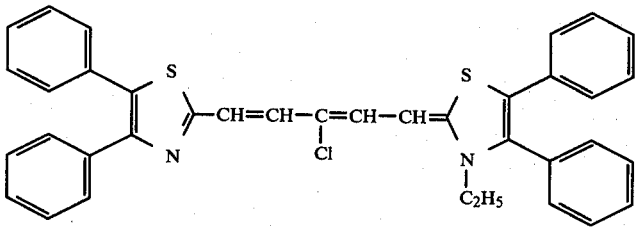
(10)
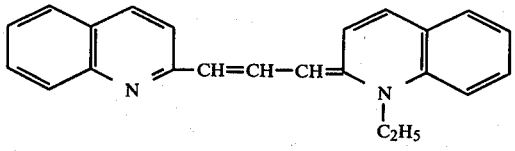
(11)
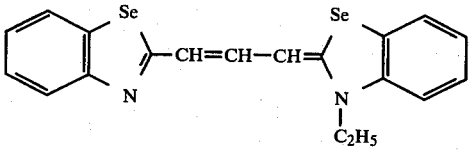
(12)
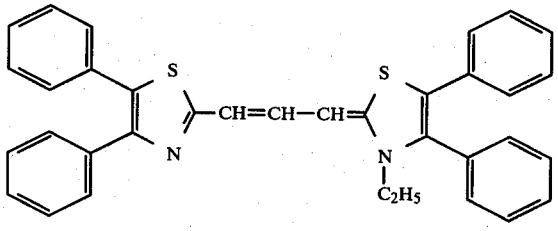
(13)
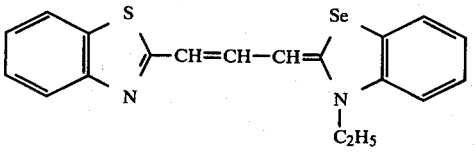
(14)
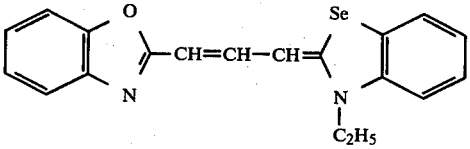

-continued (15)

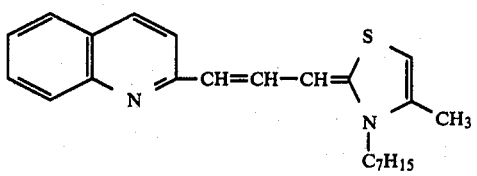

(16)

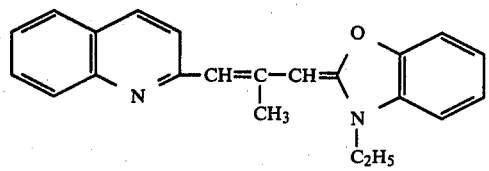

(17)

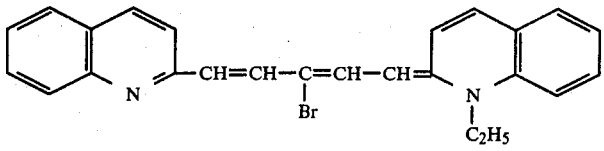

(18)

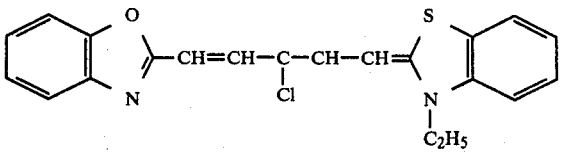

(19)

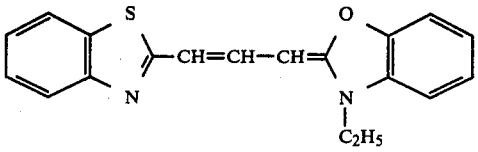

(20)

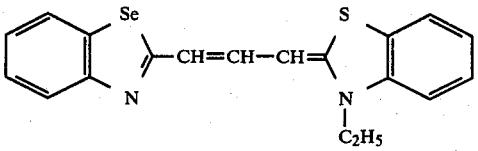

(21)

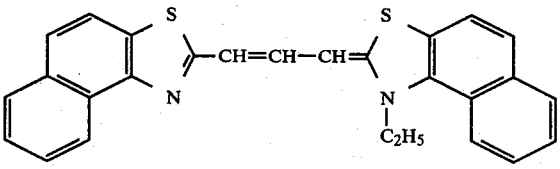

4. A complex type electrophotographic plate according to claim 1 or 2, wherein the charge transport material layer contains 1 to 50 parts by weight of one or more synthetic resin binders per part by weight of the charge transport material.

5. A complex type electrophotographic plate according to claim 1 or 2, wherein the photoconductive layer contains one or more sensitizers.

6. A complex type electrophotographic plate according to claim 1 or 2, wherein the synthetic resin binder is at least one member selected from the group consisting of linear saturated polyester resins, polycarbonate resins, acrylic resins, polyvinyl butyral resins, polyketone resins, polyurethane resins, poly-N-vinyl carbazole and poly-(p-vinylphenyl) anthracene.

7. A complex type electrophotographic plate according to claim 1 or 2, wherein the electroconductive support is a layer of aluminum, copper, palladium, gold, tin oxide, indium oxide or an alloy containing at least one metal mentioned above.

8. In an electrophotographic method comprising a first step of charging an electrophotographic plate, a second step of exposing the electrophotographic plate to light and a third step of developing the electrophotographic plate, the improvement which comprises using a complex type electrophotographic plate comprising an electroconductive support; a first layer, adhered to the support, of a charge generating material, said first layer having a thickness of 0.1 to 5 μm; and a second layer, superposed on the first layer, of a homogeneous mixture of a charge transport material and an insulating resinous binder therefor, said second layer having a thickness of 5 to 100 μm and being substantially transparent to light of a wavelength of 4200 to 8000 Å, and said charge transport material being at least one member selected from the group consisting of nonionic compounds represented by the general formula:

$$X-(CH=CH)_n-CH=Y$$

wherein X is a heterocyclic group of the formula:

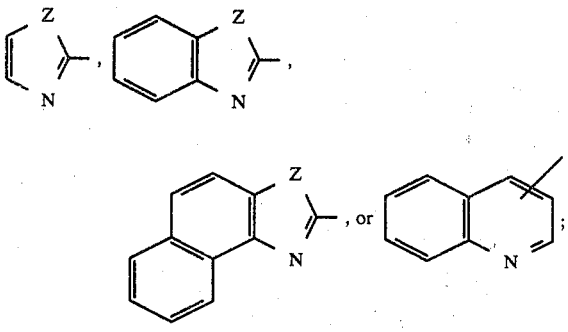

y is a heterocyclic group of the formula:

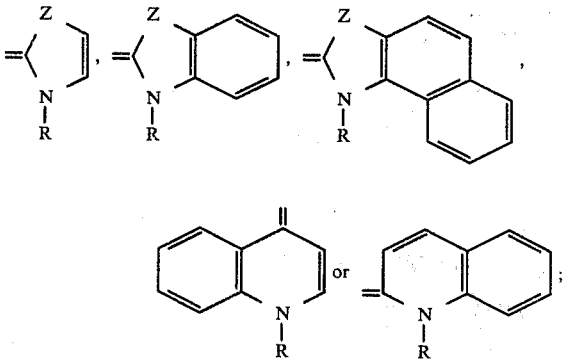

these heterocyclic groups may be substituted by one or more lower alkyl groups, halogen atoms, or phenyl groups; Z is an oxygen, sulfur or selenium atom; R is an alkyl group having 1 to 7 carbon atoms; n is an integer of 1 or 2; and one hydrogen atom in the group of the formula $-(CH=CH)_n-$ may be substituted by an alkyl group having 1 to 4 carbon atoms, a halogen atom, a phenyl group, a styryl group, a group of the formula $-N(CH_3)_2$, $-N(C_2H_5)_2$ or $-N(C_3H_7)_2$, an alkoxy group having 1 to 4 carbon atoms, or a group of the formula:

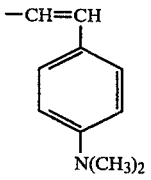

9. An electrophotographic method according to claim 8, wherein the charge generating material is at least one member selected from the group consisting of disazo pigments, squaric acid methine pigments, and phthalocyanine pigments; and a second layer, superposed on the first layer, of a homogeneous mixture of a charge transport material and an insulating resinous binder therefor, said second layer having a thickness of 5 to 100 μm and being substantially transparent to light of a wavelength of 4200 to 8000 Å, and said charge transport material being at least one member selected from the group consisting of nonionic compounds represented by the general formula:

$$X-(CH=CH)_n-CH=Y$$

wherein X is a heterocyclic group of the formula:

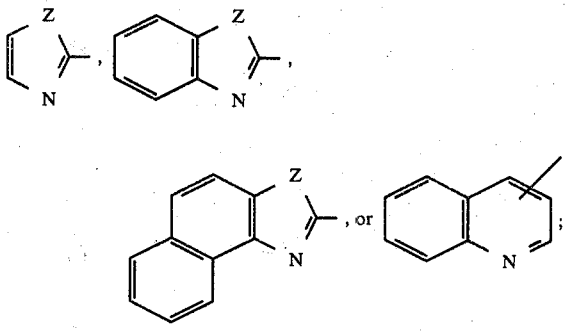

Y is a heterocyclic group of the formula:

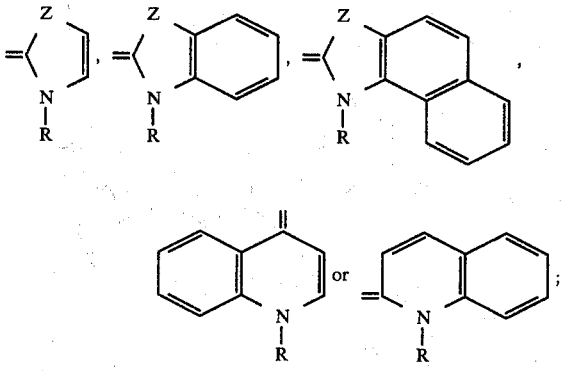

these heterocyclic groups may be substituted by one or more lower alkyl groups, halogen atoms, or phenyl groups; Z is an oxygen, sulfur or selenium atom; R is an alkyl group having 1 to 7 carbon atoms; n is an integer of 1 or 2; and one hydrogen atom in the group of the formula $-(CH=CH)_n-$ may be substituted by an alkyl group having 1 to 4 carbon atoms, a halogen atom, a phenyl group, a styryl group, a group of the formula: $-N(CH_3)_2$, $-N(C_2H_5)_2$ or $-N(C_3H_7)_2$, an alkoxy group having 1 to 4 carbon atoms, or a group of the formula:

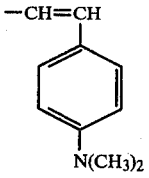

10. An electrophotographic method according to claim 8, wherein the charge transport material is at least one compound selected from the group consisting of the following compounds of (1) to (21):

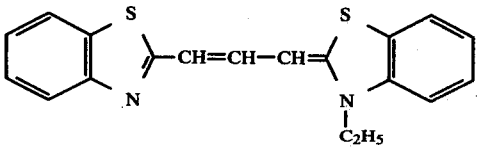
(1)
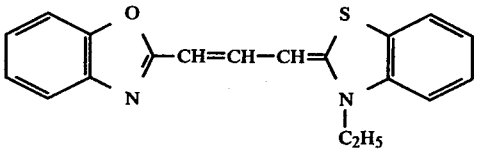
(2)
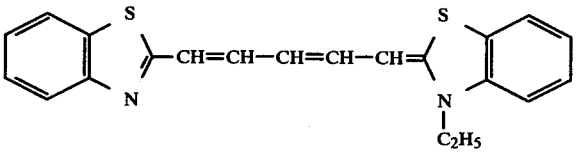
(3)
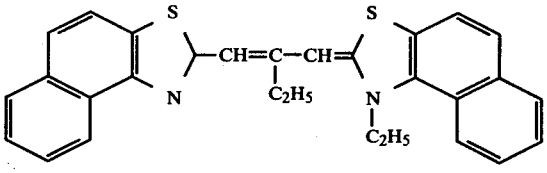
(4)
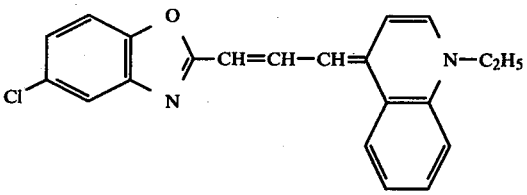
(5)
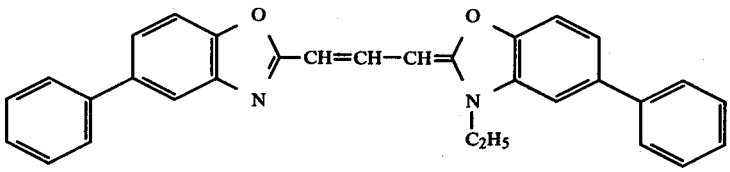
(6)
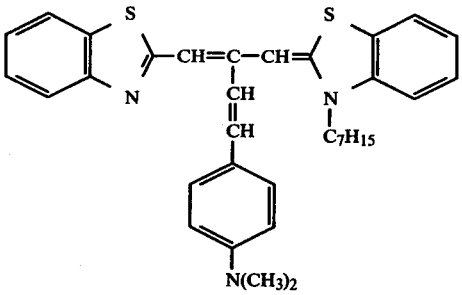
(7)
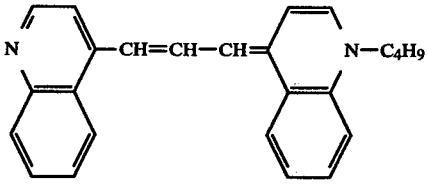
(8)

-continued
(9)
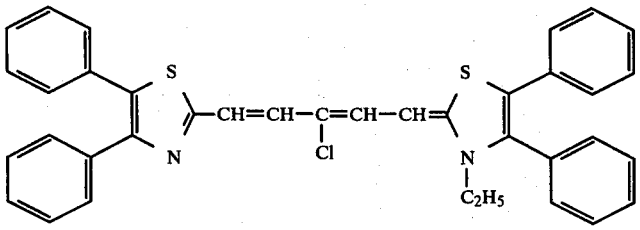
(10)
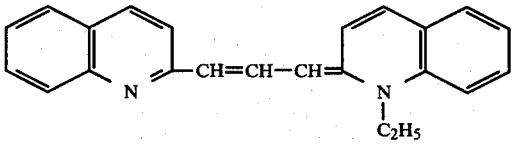
(11)
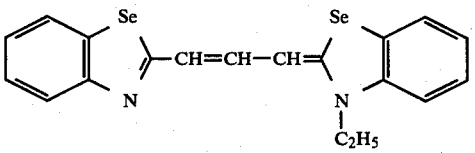
(12)
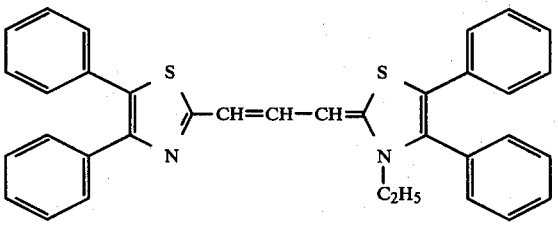
(13)
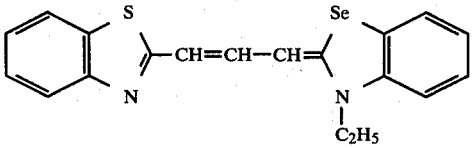
(14)
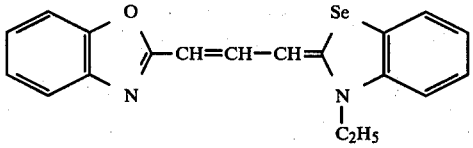
(15)
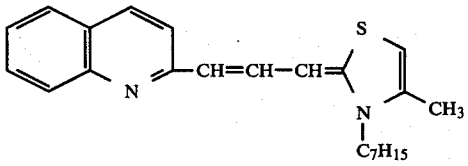
(16)
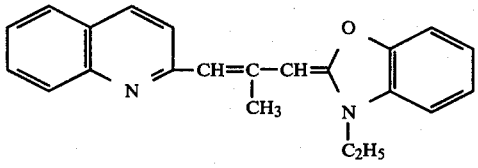
(17)
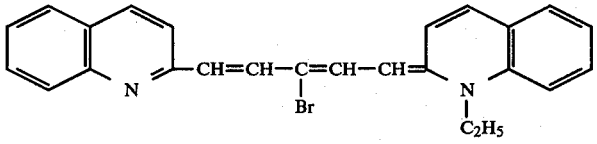

-continued

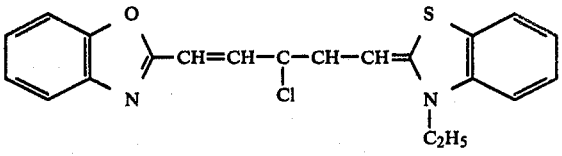

(18)

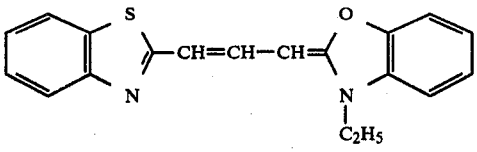

(19)

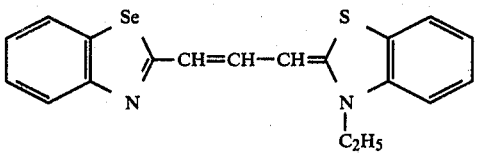

(20)

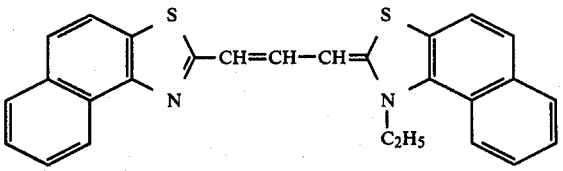

(21)

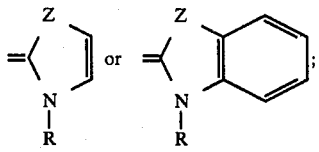

Z is oxygen or sulfur; R is an alkyl group having 1 to 2 carbon atoms; n is an integer of 1 or 2; and the heterocyclic group is unsubstituted or substituted by a phenyl group or at least one halogen atom.

11. An electrophotographic method according to claim 8, wherein the charge transport material layer contains 1 to 50 parts by weight of one or more synthetic resin binders per part by weight of the charge transport material.

12. An electrophotographic method according to claim 8, wherein the photoconductive layer contains one or more sensitizers.

13. An electrophotographic method according to claim 11, wherein the synthetic resin binder is at least one member selected from the group consisting of linear saturated polyester resins, polycarbonate resins, acrylic resins, polyvinyl butyral resins, polyketone resins, polyurethane resins, poly-N-vinyl carbazole and poly-(p-vinylphenyl) anthracene.

14. An electrophotographic method according to claim 8, wherein the electroconductive support is a layer of aluminum, copper, palladium, gold, tin oxide, indium oxide or an alloy containing at least one metal mentioned above.

15. An electrophotographic method according to claim 8, wherein said electrophotographic plate is charged negatively.

16. A complex type electrophotographic plate according to claim 1 or 2, wherein the charge transport material is at least one compound of the formula:

$$X'-(CH=CH)_n-CH=Y'$$

wherein X' is a heterocyclic group of the formula:

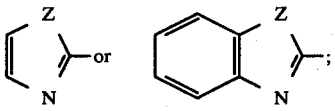

Y' is a heterocyclic group of the formula:

17. An electrophotographic method according to claim 8, wherein the charge transport material is at least one compound of the formula:

$$X'-(CH=CH)_n-CH=Y'$$

wherein X' is a heterocyclic group of the formula:

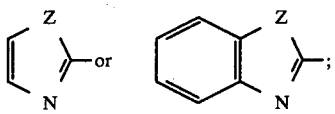

Y' is a heterocyclic group of the formula:

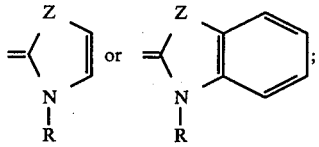

Z is oxygen or sulfur; R is an alkyl group having 1 to 2 carbon atoms; n is an integer of 1 or 2; and the heterocyclic group is unsubstituted or substituted by a phenyl group or at least one halogen atom.

18. An electrophotographic method according to claim 17, wherein the electrophotographic plate is exposed to light of the visible wavelength.

19. A complex type electrophotographic plate according to claim 1 or 2, wherein the charge transport material has a particle size of at most 5 μm.

20. An electrophotographic method according to claim 8, wherein the charge transport material has a particle size of at most 5 μm.

* * * * *